US007229232B2

(12) United States Patent
Amelung, Sr.

(10) Patent No.: US 7,229,232 B2
(45) Date of Patent: Jun. 12, 2007

(54) REINFORCED MAT FOR UNSTABLE SURFACES

(75) Inventor: Robert J. Amelung, Sr., St. Louis, MO (US)

(73) Assignee: PEM Surface Creations, Inc., St. Louis, MO (US)

( * ) Notice: Subject to any disclaimer, the term of this patent is extended or adjusted under 35 U.S.C. 154(b) by 0 days.

(21) Appl. No.: 11/065,485

(22) Filed: Feb. 24, 2005

(65) Prior Publication Data

US 2005/0191126 A1 Sep. 1, 2005

Related U.S. Application Data

(60) Provisional application No. 60/547,977, filed on Feb. 26, 2004.

(51) Int. Cl.
*E01C 9/00* (2006.01)

(52) U.S. Cl. ..... 404/36; 404/35; 238/14

(58) Field of Classification Search ..... 404/35, 404/36; 405/302.7; 238/14
See application file for complete search history.

(56) References Cited

U.S. PATENT DOCUMENTS 4,061,268 A * 12/1977 DeMaster ..... 238/14
4,468,910 A * 9/1984 Morrison ..... 52/591.2
4,596,731 A * 6/1986 Cudmore et al. ..... 428/134
5,204,159 A * 4/1993 Tan ..... 428/143
5,364,204 A * 11/1994 MacLeod ..... 404/35
5,476,339 A * 12/1995 Baranowski ..... 404/36
5,820,294 A * 10/1998 Baranowski ..... 404/36
5,972,463 A * 10/1999 Martin et al. ..... 428/95
6,696,122 B1 * 2/2004 Deschamps ..... 428/36.1

OTHER PUBLICATIONS

Hydraway 2000 brochure dated the year 2000 The Complete Waterproofing Solution.
A-B Associtcs, Inc. brochure Dated the year 1990 P.E.M. Poly Extruding Matting.

* cited by examiner

*Primary Examiner*—Gary S. Hartmann
(74) *Attorney, Agent, or Firm*—Paul M. Denk

(57) ABSTRACT

Terrain often hinders wheeled vehicles as cars mire in sand and wheeled carts in mud. Beaches, sandy playgrounds, and mud inhibit travel of wheelchairs. A reinforced mat upon a lattice of projections provides a stable surface for wheels and wheelchairs. The projections engage the terrain as the wheelchairs cross the mat toward a destination. Also, the projections take the form of spikes or hollow tubes, the mat has porosity or spaghetti like fibers, and the lattice has various patterns. The reinforced mat may be used with larger vehicles over a variety of terrain.

4 Claims, 2 Drawing Sheets

REINFORCED MAT FOR UNSTABLE SURFACES

CROSS-REFERENCE TO RELATED APPLICATIONS

This is application claims the benefit of provisional application Ser. No. 60/547,977, filed Feb. 26, 2004. The above noted application is incorporated herein by reference.

BACKGROUND OF THE INVENTION

The reinforced mat for unstable surfaces relates to pavement systems generally and more specifically to readily installed matting. A unique aspect of the present invention is a reinforcing grid with projections beneath a mat.

People, vehicles, and equipment encounter a wide variety of terrain. On foot, people traverse nearly all terrain from temperate forests and plains, beaches, swamps, to the arctic, mountains and deserts. Vehicles and equipment traverse most terrain but have limits. Vehicles and equipment have tracked or wheeled propulsion. Tracks provide their own bearing surface upon which road wheels travel. The road wheels are integral to the vehicle or equipment as is the track. Tracks allow vehicles and equipment access to sandy, wet, and unpaved areas but face limits in high slope areas like mountains. Tracks also tend to damage paved roads and to increase vehicle weight and operating costs. In contrast to tracks, wheeled vehicles drive directly upon the terrain and do not provide their own bearing surface. Wheels allow vehicles and equipment to travel at high speeds on paved or smooth surfaces but face limits on high slopes and unstable surfaces like mountains, beaches or mud. When the terrain's surface no longer bears the weight or motive forces of a wheeled vehicle, the vehicle becomes mired.

Once reinforced, a surface can usually bear wheeled vehicles. A variety of methods have sought to reinforce surfaces for wheeled vehicles. Older methods involved wooden tracks and stone causeways built across swamps and deserts. Newer methods involved interlocking metal sections placed upon a surface. The military developed this as a rapid runway repair method in numerous variations. Civilian methods have included a variety of woven fabrics and mats of organic and inorganic material for soil stabilization. Prior art designs placed mats upon unstable surfaces such as sand and mud. The mats supported wheeled vehicles of many kinds: trucks, cars, trailers, aircraft, golf carts, and wheelchairs for instance. To paraplegics and other wheelchair occupants, proper planning prevents poor performance. A wheelchair occupant chooses a route to avoid terrain with a high likelihood of miring a wheelchair.

The present art overcomes the limitations of the prior art. That is, the art of the present invention, a reinforced mat for unstable surfaces, prevents movement and rutting of a mat. Wheelchair occupants hold in high importance the performance of their equipment. With the application of the present invention, a wheelchair occupant can have a path on sandy beaches, sports paths and playgrounds, and upon wet and muddy terrain. The reinforced mat allows those with walking difficulties and wheelchair occupants to cross unstable surfaces. As an adaptive device, the reinforced mat for unstable surfaces performs to the satisfaction of wheelchair occupants and others, and expands the terrain accessible to them.

The difficulty in providing a reinforced mat for unstable surfaces is shown by a typical mat. The reinforced mat for unstable surfaces started with poly extruded matting P.E.M.® products used on many surfaces. Alone P.E.M.® matting products covered unstable surfaces but developed ruts and shifted position with the passage of many wheeled vehicles. Ruts would develop in the mats as the underlying surface deflected due to the weight of the vehicles. In some mats, narrow width wheels would pinch the mat material and bind the wheels. Ruts became an obstacle to wheelchairs.

Reinforced matting systems are known in the prior art. The military has used AM2 matting for decades. AM2 is an interlocking series of square plates with molded edges. The plates are at least three feet on a side, take much labor to install, and bear the weight of landing aircraft. The military has also used sheet metal punched with holes as sections. These sections assembled into a grid to make a runway in rough terrain. The sections required significant transportation assets for delivery and labor for installation or removal.

In civilian applications, matting comes in a variety of materials. Matting can be organic to stabilize terrain while permitting growth of vegetation. This matting sees use on hillsides and erosion control projects, but does not support vehicle traffic. Inorganic matting sees numerous uses. As solid sheets, matting can be staked to a surface however, vehicle traffic will move sheet matting out of position and permit ruts due to deflection of the ground surface beneath the sheet. As a perforated sheet, matting permits vehicle traffic but requires staking lest the traffic reposition the sheet. Perforated sheets permit ruts unless vegetative re-growth succeeds. Generally, matting requires separate staking to withstand vehicle traffic.

Thus, prior art devices do not provide for a device combining matting and staking into one material. The present invention does have a reinforcing lattice with projections beneath a mat.

SUMMARY OF THE INVENTION

Terrain with sand or moisture often hinders wheeled vehicles and equipment. Cars get stuck in sand or mud regularly as do wheeled carts. In particular, beaches, sandy playgrounds, and mud inhibit wheelchairs from certain terrain and reduce the quality of life for the wheelchair occupants and others. The present invention improves ground transfer and environmental adaptation as it adds a mat to the ground surface and as it increases access for wheelchair occupants to a variety of terrain. A porous flexible mat upon a lattice and projections extending from the lattice provide a more stable surface for wheel chairs. The projections engage the terrain as the wheel chairs cross the mat toward a destination. The mat further assists people having gait or stride difficulties as they walk upon unstable surfaces. Alternatively, the reinforced mat has projections in the form of spikes or hollow tubes, spaghetti like fibers, glue, heat welding, or spot welding to join the mat to the lattice, and a variety of patterns for the lattice.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved reinforced mat for unstable surfaces.

Another object is to provide a reinforced mat that can be easily and efficiently manufactured and marketed to the consuming public.

Another object is to provide a reinforced mat that allows a wheelchair or other equipment to cross sandy or wet terrain without miring.

DETAILED DESCRIPTION OF THE PREFERRED EMBODIMENT

Figure 1:
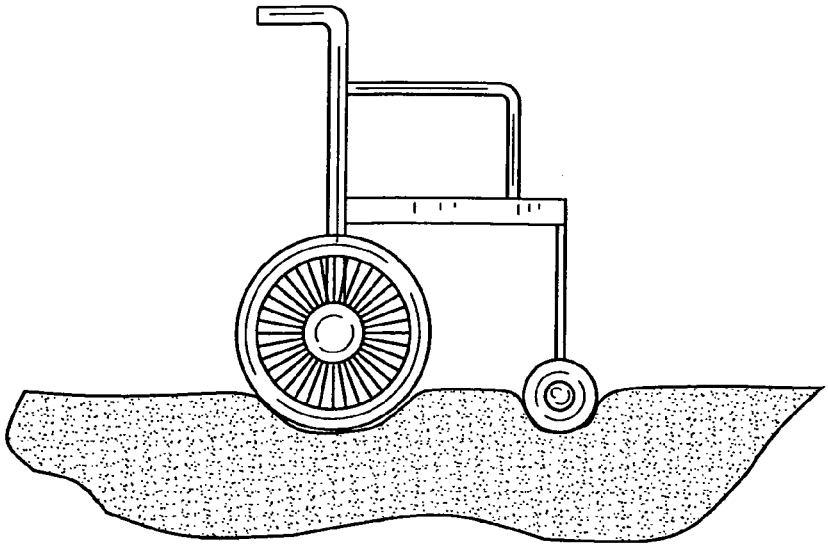
FIG. 1 shows a side view of a wheeled vehicle, such as a wheelchair, becoming mired upon sandy terrain.

The present art overcomes the prior art limitations by projections beneath a fibrous mat. Turning to FIG. 1, vehicles and equipment encounter a variety of terrain from paved roads to submerged fords and conditions in between. Vehicles have tracks or wheels for propulsion. Tracked vehicles usually press ahead through all terrain. On the other hand, wheeled vehicles have their weight born on the terrain surface. Wet or granular surfaces readily become unstable, form ruts, and bear less vehicle weight. In particular, wheelchairs with narrow width wheels quickly get stuck in sand and mire in damp earth as shown in FIG. 1. A wheelchair alone has limited environmental adaptation and requires heightened effort for ground transfer. In a ground transfer, people firmly plant their arms upon the ground and lift themselves into their wheelchairs.

Figure 2A:
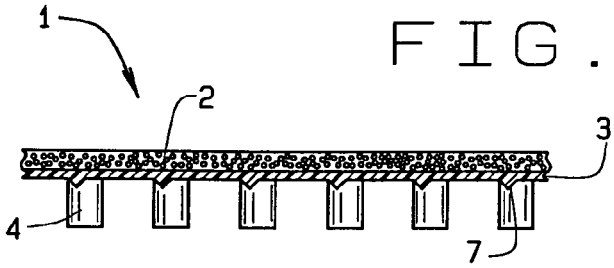
FIG. 2*a* shows an oblique view of the preferred embodiment of the reinforced mat constructed in accordance with the principles of the present invention having tubes as projections.
Figure 2B:
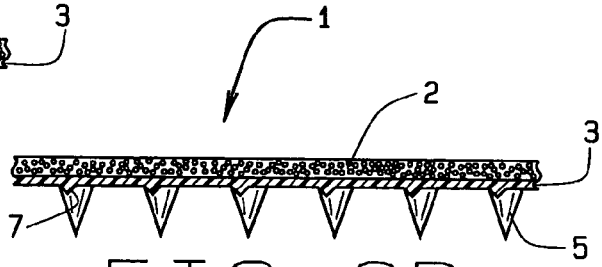
FIG. 2*b* shows an oblique view of the preferred embodiment of the reinforced mat constructed in accordance with the principles of the present invention having spikes as projections.

Wheelchair occupants avoid beaches, wet trails, and damp paths due to the risk of becoming mired. A system to reduce the risk of wheelchairs becoming mired in sand and mud is shown in FIGS. 2A & 2B. The system paves the way to rehabilitate worn paths, trails, roads, and other support surfaces that impede travel by wheelchair occupants. Wheelchair occupants hold in high importance, the performance of their equipment. Added to an unstable surface, the system adapts the environment to improve access for wheelchair occupants and others. The system stabilizes the ground surface which makes transferring a person from the ground to a wheelchair or from a vehicle to a wheelchair easier. In a ground transfer, people firmly plant their arms upon the invention to lift themselves into their wheelchairs. The present invention improves and simplifies ground transfers for wheelchair occupants alone or with the help of others.

The system is a laminate of two layers. The top layer is a plastic mat 2, such as P.E.M.® poly extruded mat made of PVC (polyvinyl chloride), that reduces slipping under wet conditions. The mat 2 exceeds minimum slip resistance specified in ASTM F-1677-96 for level and 3:1 slopes in wet and dry conditions. The mat 2 has porous construction that allows moisture, light, and air to pass. The porous mat 2 eliminates standing water and an antimicrobial agent reduces algal, mildew, fungal, and bacterial growth within the mat 2. The mat 2 resists ultraviolet light and wind uplift, and withstands temperatures from −35° F. thru 180° F. The mat 2 withstands the weather and chemicals, and does not leach plasticizers.

The bottom layer is a lattice 3 of molded polypropylene with depending projections 4. In the preferred embodiment, the projections 4 are hollow tubes as in FIG. 2A. In an alternate embodiment, spikes 5 are the projections 4 shown in FIG. 2B. The spikes 5 are conical in shape with the base of the shape upon the lattice 3. In the preferred embodiment, the mat 2 is laminated to the lattice 3 using a high strength thermoplastic adhesive. The mat 2 joins the lattice 3 opposite from the depending projections 4. In an alternate embodiment, the mat 2 joins to the lattice upon application of high temperature.

Figure 3:
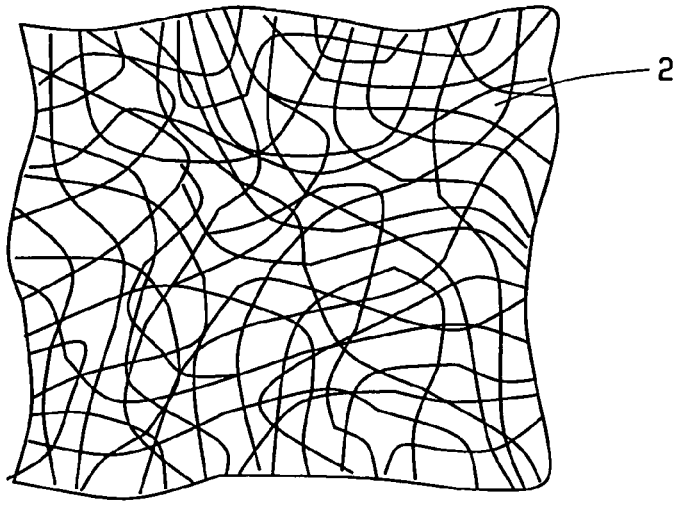
FIG. 3 shows a plan view of the reinforced mat for unstable surfaces.

Over in FIG. 3, the porous mat 2 has a construction of numerous fibers. The fibers appear like irregular spaghetti strands but, are made of a flexible plastic PVC. The strands loop and cross one another in a non-woven mat 2 with little apparent pattern. The strands form a mat 2 upon heat and pressure bonding.

Figure 4:
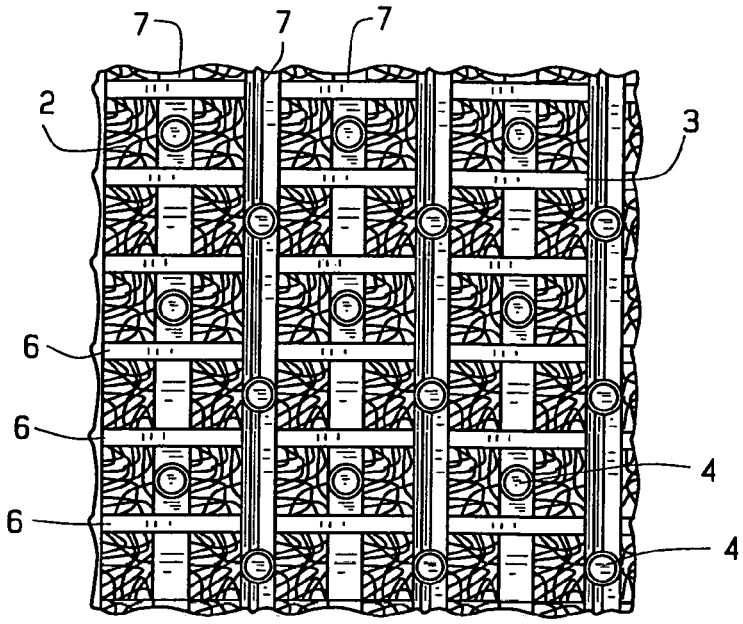
FIG. 4 shows a plan view of the underside of the reinforced mat for unstable surfaces; and, FIG. 5 shows a side view of a wheel upon the reinforced mat for unstable surfaces.

Then in FIG. 4, the lattice 3 has a grid of weft members 6 and perpendicular woof members 7 beneath the mat 2. In the preferred embodiment, the woof members 7 are wider than the weft members 6. Alternating woof members 7 have an applied reinforcement running lengthwise, i.e. perpendicular to the weft members 6. The projections 4 depend from the woof members 7 and the projections 4 on adjacent woof members 7 are offset. In the preferred embodiment, the projections 4 are round hollow tubes. In an alternate embodiment, spikes 5 serve as the projections 4.

Figure 5:
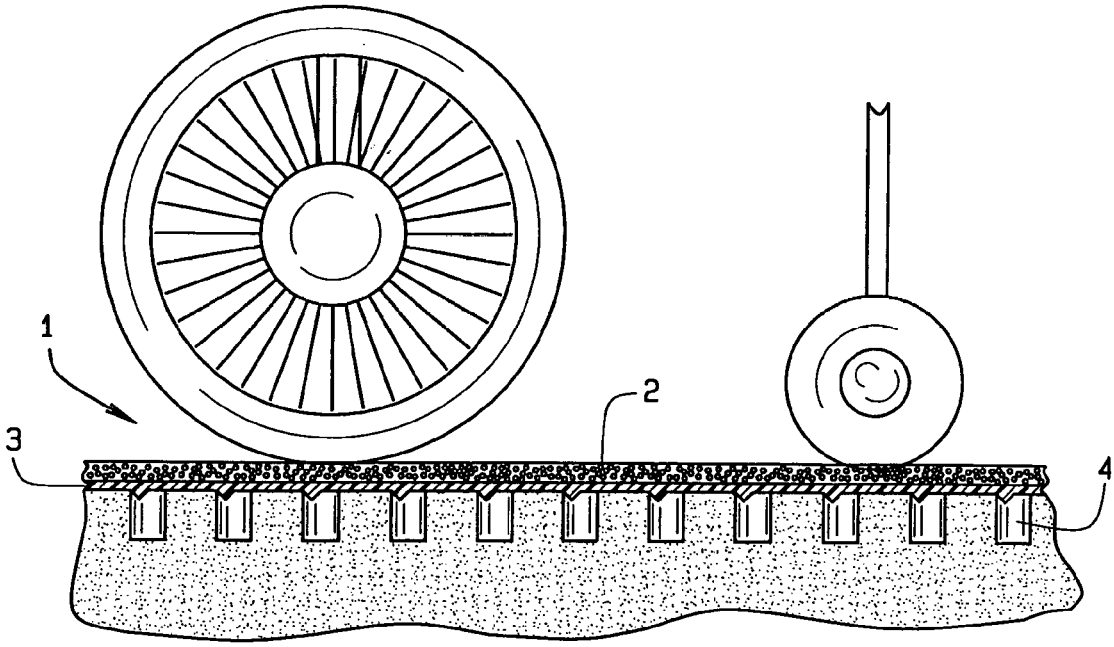

The present invention has lower installation costs compared to traditional paving such as concrete, asphalt, brick and boardwalks that have higher material and labor costs. To utilize the present invention, an installer properly plans and selects the size and color for the reinforced mat 2 from the three foot and six foot wide rolls available in a variety of colors. The reinforced mat 2 simply unrolls to twenty five foot sections for splicing end to end or side to side. A crew then presses the reinforced mat 2 into an unstable surface where the projections 4 anchor the reinforced mat 2. Wheeled vehicles can then cross the reinforced mat 2 upon an unstable surface as shown in FIG. 5. A proper installation prevents the frustrations arising from a poorly performing matting system or existing surface. Wheelchair occupants and experienced construction crews know that proper planning prevents poor performance in many tasks.

Following use, the reinforced mat 2 removes readily for rolling and then storage. For example, on a beach, the reinforced mat 2 can be installed at low tide allowing access to the water's edge. As the tide advances, rolling back the reinforced mat 2 up the beach prevents the tide from depositing sand and debris upon the mat 2. The reinforced mat 2 can be used anywhere an unstable surface requires reinforcement for an event, wheeled vehicles, wheeled equipment, or access by wheelchair occupants.

From the aforementioned description, a reinforced mat for unstable surfaces has been described. The reinforced mat for unstable surfaces is uniquely capable of resisting ruts while allowing access to unstable surfaces for wheeled vehicles and equipment. The reinforced mat for unstable surfaces and its various components may be manufactured from many materials including but not limited to polymers, polyvinyl chloride, polyethylene, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

The invention claimed is:

1. A reinforced paving system for use on unstable surfaces as sandy beaches and playgrounds, wet areas, and trails and fields, and other terrain where wheeled equipment and wheeled vehicles risk miring, comprising:

a porous flexible mat having fibrous non-woven construction and numerous irregular voids to transmit water, air, and light;

a lattice having a plurality of depending projections, said lattice joining to said mat opposite from said depending projections, said lattice being formed of a grid with parallel projections arrayed upon said grid, said grid having weft members and perpendicular woof members, alternate ones of said weft members are reinforced, and said projections locating away and depending from the intersections of said weft members and said woof members; and each of said depending projections comprising a hollow tube having central cavity therein, such that when the reinforced paving system is applied to an unstable surface, the hollow tubes embed within the surface and affix the reinforced paving system in place and prevents its movement or miring upon the unstable surface.

2. The paving system of claim 1 wherein said mat laminates to said lattice with an adhesive.

3. The paving system of claim 1 wherein said mat joins to said lattice by application of heat.

4. The paving system of claim 1 further comprising:

said mat having an antimicrobial agent and a resistance to degradation by ultraviolet light.

* * * * *